US007273328B2

(12) United States Patent
Hunter et al.

(10) Patent No.: US 7,273,328 B2
(45) Date of Patent: Sep. 25, 2007

(54) EMISSIVE HIGHWAY MARKERS

(75) Inventors: Charles Eric Hunter, Jefferson, NC (US); Drew G. Narayan, Durham, NC (US)

(73) Assignee: Next Safety, Inc., Jefferson, NC (US)

( * ) Notice: Subject to any disclaimer, the term of this patent is extended or adjusted under 35 U.S.C. 154(b) by 0 days.

(21) Appl. No.: 10/947,053

(22) Filed: Sep. 22, 2004

(65) Prior Publication Data

US 2005/0196237 A1 Sep. 8, 2005

Related U.S. Application Data

(63) Continuation of application No. 10/384,197, filed on Mar. 7, 2003, now abandoned.

(60) Provisional application No. 60/352,551, filed on Mar. 8, 2002.

(51) Int. Cl.
*E01F 9/00* (2006.01)

(52) U.S. Cl. ..... 404/12; 404/9; 404/15; 340/815.45

(58) Field of Classification Search ..... 404/9, 404/12, 15; 359/551; 340/815.45
See application file for complete search history.

(56) References Cited

U.S. PATENT DOCUMENTS

| | | | |
|---|---|---|---|
| 3,302,168 A | 1/1967 | Gray et al. | |
| 3,529,254 A | 9/1970 | Villemain | |
| 3,544,939 A | 12/1970 | Hawks | |
| 3,585,565 A | 6/1971 | Groez | |
| 3,996,556 A | 12/1976 | Eigenmann | |
| 4,050,834 A | 9/1977 | Lee | |
| 4,668,120 A | 5/1987 | Roberts | |
| 4,904,998 A | 2/1990 | Niimi | |
| 4,925,335 A | 5/1990 | Eigenmann | |
| 4,955,982 A | 9/1990 | Paulos | |
| 5,013,181 A | 5/1991 | Harrison | |
| 5,074,706 A | 12/1991 | Paulos | |
| 5,109,224 A | 4/1992 | Lundberg | |
| 5,252,893 A | 10/1993 | Chacham et al. | |
| 5,257,020 A | 10/1993 | Morse | 340/908.1 |
| 5,313,188 A | 5/1994 | Chol et al. | 340/331 |
| 5,412,381 A | 5/1995 | Dicks | |
| 5,469,157 A | 11/1995 | Carperiter et al. | 340/908.1 |

(Continued)

FOREIGN PATENT DOCUMENTS

| | | |
|---|---|---|
| EP | 1 179 637 | 2/2002 |

(Continued)

OTHER PUBLICATIONS

"3.3 Color in Image and Video", http://fee.efu.ca/cs/undergrad/CourseMaterials/CMPT479/material/notes/Chap3/Chap3.3, downloaded and printed on Jun. 24, 2002.

(Continued)

*Primary Examiner*—Gary S. Hartmann
(74) *Attorney, Agent, or Firm*—Thomas, Kayden, Horstemeyer & Risley, LLP

(57) ABSTRACT

A highway marker and vehicle mounted detection system in which the highway marker includes LEDs of different colors that can be selected under different conditions, and non-visible light LEDs for transmitting information to passing vehicles and between highway markers.

15 Claims, 2 Drawing Sheets

U.S. PATENT DOCUMENTS

| | | | | |
|---|---|---|---|---|
| 5,680,033 | A | 10/1997 | Cha | |
| 5,703,719 | A | 12/1997 | Chen | |
| 5,782,552 | A | 7/1998 | Green et al. | |
| 5,782,553 | A | 7/1998 | McDermott | |
| 5,839,816 | A | 11/1998 | Varga et al. | |
| 5,848,837 | A | 12/1998 | Gustafson | 362/235 |
| 5,896,093 | A | 4/1999 | Sjobom | 340/815.75 |
| 5,897,271 | A | 4/1999 | Widmer | |
| 5,917,432 | A | 6/1999 | Rathbone | |
| 5,951,144 | A | 9/1999 | Gavigan et al. | |
| 5,984,570 | A | 11/1999 | Parashar | |
| 6,059,488 | A | 5/2000 | Green | |
| 6,079,899 | A | 6/2000 | Green | |
| 6,250,774 | B1 * | 6/2001 | Begemann et al. | 362/231 |
| 6,305,874 | B1 | 10/2001 | Custers et al. | |
| 6,354,714 | B1 | 3/2002 | Rhodes | |
| 6,498,570 | B2 | 12/2002 | Ross | 340/901 |
| 2002/0006313 | A1 | 1/2002 | Pas | |
| 2002/0008973 | A1 | 1/2002 | Boys et al. | |
| 2002/0012244 | A1 | 1/2002 | Van Der Poel et al. | |

FOREIGN PATENT DOCUMENTS

| | | |
|---|---|---|
| WO | 97/03250 | 1/1997 |
| WO | 98/30834 | 7/1998 |
| WO | 00/63730 | 10/2000 |
| WO | 01/31125 | 5/2001 |
| WO | 01/58219 | 8/2001 |

OTHER PUBLICATIONS

"Kodak Research and Development: Color Science", http://www.kodak.com.corporate.RaDmain.whatwedo.colorscience, downloaded and printed on Jun. 24, 2002.

"Human Color Vision", http://www.cs.unc.edu/~najunder/color/node12.html, downloaded and printed on Jun. 24, 2002, dated 1999.

"The Power of Light" http://www.intl-light.com/handbook/ch02.html, downloaded and printed on Jun. 24, 2002, dated 1997.

"Daylight: Is It in the Eye of the Beholder?", http://www.soluxtli.com/edu13.htm., downloaded and printed on Jun. 24, 2002.

"Photopic Luminous Efficiency Function of the Human Retina", http://www.4colorvision.com/files/photopiceffic.htm., downloaded and printed on Jun. 24, 2002.

"Simulation of Human Visual Response at Varying Levels of Illumination", http://www.cs.berkeley.edu/~efros/java/vision/vision.html., downloaded and printed on Jun. 24, 2002.

"The Nature of Light and Color", http://www.adobe.com/support/techguides/color/colortheory/light, downloaded and printed on Jun. 24, 2002.

"The Interaction of Light and Matter", http://www.adobe.com/support/techguides/color/colortheory/matter, downloaded and printed on Jun. 24, 2002.

"Perception Variables", http://www.adobe.com/support/techguides/color/colortheory/variables, downloaded and printed on Jun. 24, 2002.

"The Physiology of Human Vision", http://www.adobe.com/support/techguides/color/colortheory/vision,downloaded and printed on Jun. 24, 2002.

* cited by examiner

EMISSIVE HIGHWAY MARKERS

CROSS REFERENCE TO RELATED APPLICATION

This is a continuation of application Ser. No. 10/384,197, filed Mar. 7, 2003 now abandoned.

This application claims priority to U.S. Provisional Application Ser. No. 60/352,551, filed Mar. 8, 2002, which is incorporated herein by reference in its entirety.

FIELD OF THE INVENTION

The invention relates to highway markers, more particularly to emissive highway markers that include light sources that emit electromagnetic radiation of desired wavelength(s) to enhance highway safety.

BACKGROUND

Thousands of people die on America's highway each year because of poor roadway markers. Many of these deaths occur in accidents that are attributable to low light conditions or an inability of the driver to adequately see curves and bends in the approaching roadway. Driving at night can be particularly difficult because many human beings have a lessened visual acuity in low light conditions. Conventional highway markers that are purely reflective do not adequately meet the needs of many people with such lessened visual acuity.

A fundamental problem with traditional reflective highway markers is that they reflect light in a straight path even though many roadways are not necessarily straight. Additionally, automotive headlights do not have consistent optical power across a wide viewing angle. As such, optional power declines at the outer edges of the headlight. This phenomenon is characteristic of all back-reflective headlights.

Still another problem with conventional highway markers commonly in use on highways today is that they reflect light of a wavelength that is not easily detected by the human eye in low ambient light conditions. Many reflective highway markers are yellow. However, yellow is not necessarily the optimal color for detection by the human eye in low light conditions. For example, the lighting of airport runways is typically done using blue lights because the human eye sees the wavelength of blue light better than it can see light of the yellow wavelength. What is needed are highway markers that can help reduce the number of injuries and fatalities that occur on highways due to accidents precipitated by inability to see highways, obstructions in the road, or other dangers that drivers can encounter while traveling in low light conditions.

SUMMARY

A highway marker system that comprises an emissive device positioned on a highway, wherein said emissive device emits electromagnetic radiation.

BRIEF DESCRIPTION OF THE DRAWINGS

FIG. 1 B is a side view perspective of the emissive highway marker of the present invention.

DETAILED DESCRIPTION

Reference will now be made in detail to embodiments of the invention, examples of which are illustrated in the accompanying drawings. Whenever possible, the same reference numbers will be used throughout the drawings to refer to the same or like elements.

Emissive highway markers overcome the deficiencies of traditional reflective highway markers illuminated by back reflective automotive headlights because they give the driver better opportunity to see curves and bends in a highway. Emissive highway markers are capable of adjust the color of light emitted in response to ambient light conditions. Various colors of light can be used to convey information to the driver, such as the presence of an intersection, a road hazard, inclement weather or the need to be on a radio to receive regional or national emergency broadcast instructions. The disclosed markers may also be equipped to monitor the relative position and speed of passing vehicles and to communicate that information to a computer on board the vehicle.

Figure 1A:
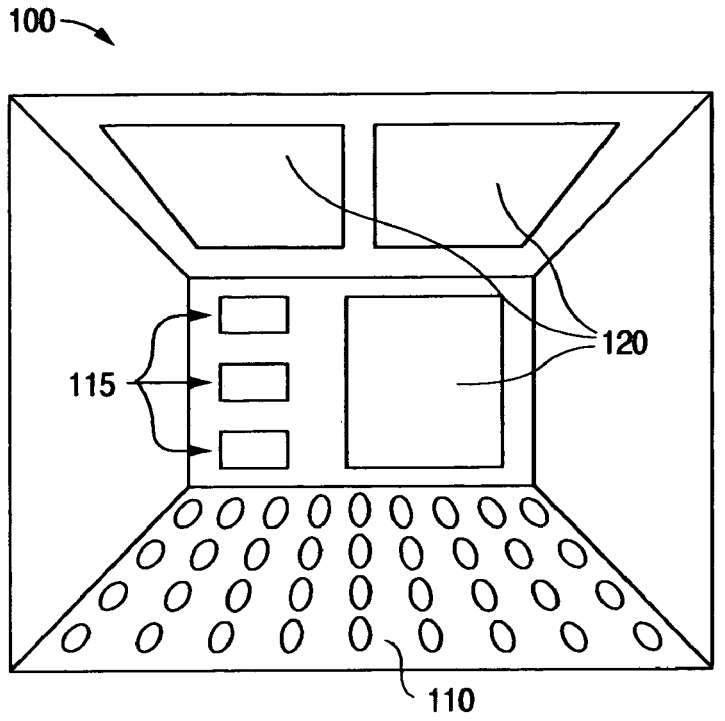
FIG. 1 A is a top view perspective of the emissive highway marker of the present invention.
Figure 1B:
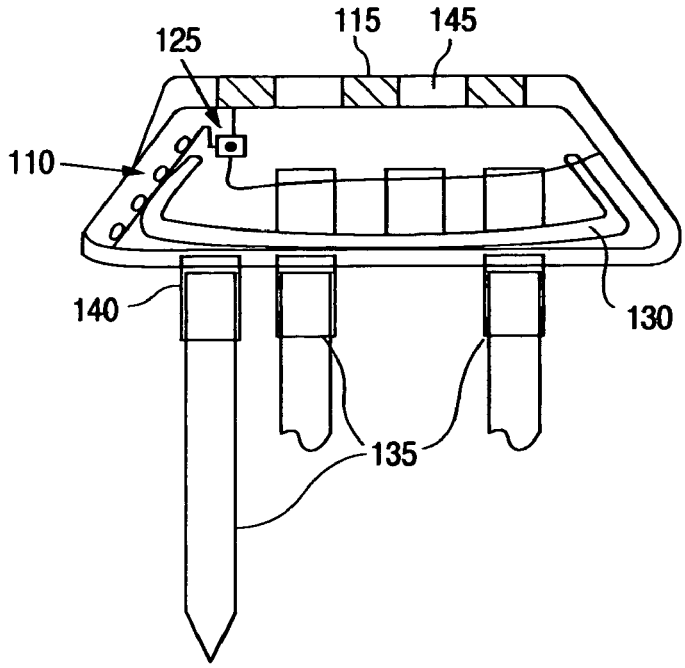

Referring to FIGS. 1A and 1B, top and side views of an emissive highway marker 100 are shown. FIG. 1A illustrates an light-emitting diode (LED) array 110, a plurality of photodetectors 115, and a plurality of photovoltaic cells 120. FIG. 1 shows ASIC current drivers 125, an aluminum cooling fin 130, aluminum alloy cooling/positioning rods 135, a stress absorbing spring 140, and a plastic or metal shell 145 which contains the assemblage. The housing would also contain reflective materials to increase the overall visibility of the marker (not shown). As is discussed further below, marker 100 may further include a microprocessor and radio transmitter and receiver.

In an embodiment, LED array 110 can be constructed of one or more LED's that emit varying wavelengths of light. LED array 110 can include several types of LED's capable of emitting red, yellow, green, blue, white, or other colors of light. LED array 110 may also include LED's that emit light in the non-visible spectrum. Some examples of LED's that would be suitable for use in the present invention include, but are not limited to, LED's that emit light in the blue and green portion of the electromagnetic spectrum. These devices will, for example, typically be fabricated from indium gallium nitride and/or gallium nitride layers with or without suitable buffer layers on 6H or 4H silicon carbide substrates (where 6H is the polytype or atomic arrangement), aluminum oxide substrate, gallium nitride substrates or aluminum nitride substrates. Typically, LED's that are suitable for use in the present invention will be constructed from a substrate that allows high thermal conductivity and high optical transmissivity. While LED manufacturing techniques using aluminum nitride substrates are still evolving, there are other commercially available devices suitable for number 100, such as nitride devices grown on both $Al_2O_3$ and silicon carbide substrates.

The basic function of traditional LED's is well known and need not be discussed in great detail. In summary, applying a voltage across the semi-conductive material of the LED induces an electron to move from the valence band to the conduction band. When the electron falls back down to the conduction band, it recombines with "holes" and causes the LED to emit a photon. One drawback to traditional LED technology is that optoelectronic devices degrade over time and lose power efficiency. As LED=s degrade, the wavelength of the light emitted by the LED will change, causing a shift in the color of the light produced Marker 100 may be constructed using LED=s that are not as susceptible to degradation. For example, LED array 110 may employ LED=s fabricated from gallium nitride grown on Al silicon carbide, gallium nitride or aluminum nitride. These devices emit electromagnetic radiation in the ultraviolet (UV) or blue portion of the spectrum and are coated with a phosphor. The UV emission striking the phosphor-coated diode creates a stimulated emission of white light that is not susceptible to color shift. The LED can in turn be placed inside a blue or green tinted material, such as plastic, that functions as a lens/filter to create blue or green light that is not subject to a color shift Alternatively, the phosphor-coated LED can itself emit light of a desired color, such as blue, green, yellow or red. Further, other LED=s systems may be used as well.

In certain embodiments, the choice of light emitting semiconductor device may depend on the environment in which marker 100 is intended for use. In addition, embodiments of marker 100 are not limited by the type of LED used.

The number of LED's or other light emitting semiconductive devices used in the construction of marker 100 may also vary according the environment. In addition to degradation over time, the lifetime of an optoelectronic device is a function of the drive current supplied to the device and the ambient temperature of the environment in which the LED operates. For example, highway surfaces can become very hot, and driving an optoelectronic device at its rated current in such a hot environment may cause rapid degradation in the device. An embodiment of marker 100 may be constructed using a plurality LED's or other optoelectronic devices. In this case, each emissive highway marker may be operated at a low drive current while still providing sufficient emission of light from the marker to be visible to the human eye in low light conditions.

In one embodiment photodetectors 115 can be used to control the emissions of the optoelectronic devices in response to changes in ambient light conditions. Photodetectors 115 interface with a microprocessor or an ASIC (not shown). Photodetectors 115 measure ambient light conditions and provide a signal that is a function of how many photons of light are impinging on the detector. The signal from photodetector 115 can cause marker 100 to alter the color of light emitted by LED array 110 in varying conditions. For example, the human eye has a much higher responsivity to green light in high ambient light conditions than it does to blue light, while in low light the human eye has a higher responsivity to blue light. So in high ambient light conditions, marker 100 may emit green light, while in low ambient light conditions, blue light can be produced by LED array 110. Each marker can be equipped with the necessary optoelectronic devices for producing each different color. Markers can also be controlled to emit other colors to signal the driver that he is approaching a stop sign or an intersection.

Marker 100 can be controlled by a plurality of different mechanisms. For example, marker 100 can be given a manual setting at the time the marker is installed. Alternatively, the marker could be controlled by an optically-activated device equipped with a microprocessor or an ASIC that is responsive to non-visible radiation such as IR or RF to permit remote control of the marker in a manner similar to a TV remote control. Marker 100 may also use a temperature measurement device that causes the marker to emit a particular color of light in response to changes in the ambient temperature. This embodiment would allow the motorist to be warned that the roadway surface, in particular bridges, may have an unusual condition, such as being icy. Similarly, detection mechanisms for moisture on the roadway surface can be used in conjunction with the markers, which allows the motorist to be warned that the road surface may be wet or slippery. The color of the markers may also change to indicate that the motorist should tune in to an Emergency Management System radio broadcast, such as in the event of a severe weather or other emergency.

LED arrays 110 can emit both visible and non-visible electromagnetic radiation. The non-visible radiation can be used to signal an enunciator device inside a vehicle to track the position of the vehicle relative to the boundaries of the highway, such as the median or the shoulder.

In another embodiment, optoelectronic devices such as laser diodes in combination with a light emitting diode having a narrow viewing angle, that emit IR or UV can be used to produce the signal. The diodes can broadcast a multidirectional signal that is unique to the marker. This signal can carry information regarding the position of the individual marker and other traffic information.

Figure 3:
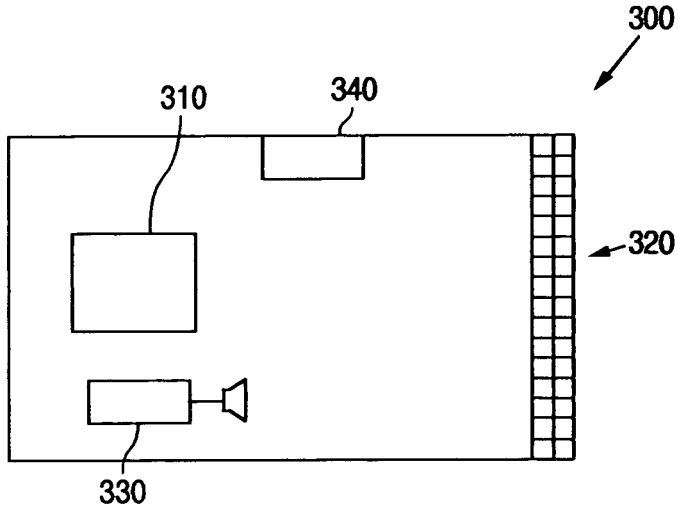
FIG. 3 is a block diagram of a vehicle mounted detector system of the invention.

As shown in FIG. 3, a detector system 300 on the vehicle would receive the signal from the marker. A computer 310 within the vehicle will be able to determine the exact position of the vehicle relative to the markers by "listening" to multiple markers. This could be accomplished in two ways. First, the marker could send information in predetermined intervals. Second, information regarding the interval could be incorporated in the signal. With the time interval emitted and the time interval received, the computer would be able to determine the vehicle's magnitude of velocity with respect to one marker. Thus based on multiple markers, the computer could triangulate the vehicle's position relative to the markers.

The detector system could be composed of one photodetector, several photodetectors, or in a preferred embodiment, an array of photodetectors 320. The array of photodetectors 320 would contain a plurality of devices tuned to specific wavelengths outside the visible spectrum. Certain photodetectors could have bandpass filters. These devices integrated into an array would cover large portions of the spectrum, thereby creating a solid state spectrographer. This would vastly increase the amount of information that could be transmitted from the markers to the detector system.

An enunciator 330 in the vehicle can warn the driver and passengers of the vehicle in the event the vehicle is traveling too close to the shoulder or median or is traveling too fast for road conditions, or is approaching an intersection or stop sign or some other warning. The speed and position data gathered by a vehicle's computer from the markers may also be used to automatically print speeding tickets. In addition, discreet marker locations can work in conjunction with a global positioning system (GPS) 340 to provide exact street and highway location, confirmation or annunciation.

Markers 100 can also detect the presence of a stopped vehicle or other obstruction in the roadway. The presence of a stopped vehicle or other obstruction can cause the marker detecting the obstruction to signal other highway markers in the proximity of the obstruction to emit, for example, a yellow light indicating the potential hazard. The signal may be sent between markers via any medium, including IR and RF.

Figure 2:
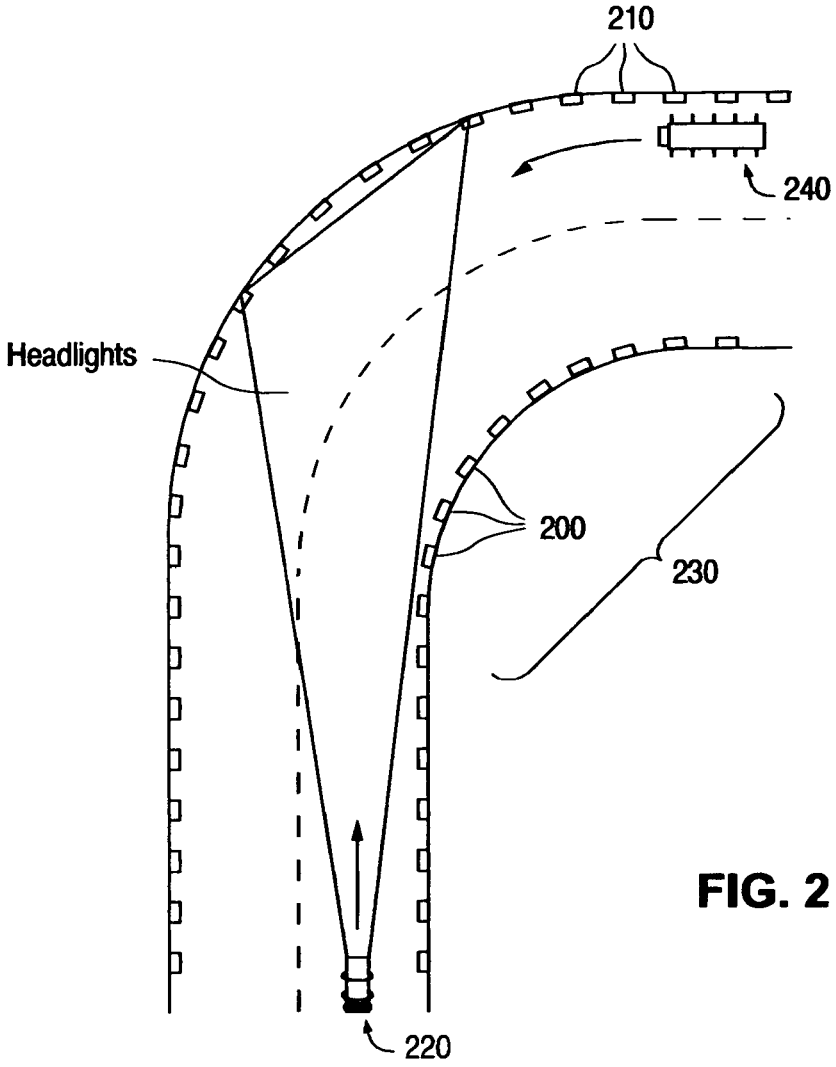
FIG. 2 is an illustration of a highway equipped with emissive highway markers.

FIG. 2 shows a section of a highway equipped with markers as described above. Markers 200 emit light according to the ambient conditions to delineate a curve 230 in the highway. For example, markers 200 may emit blue light at night. Alternatively, markers 200 may emit green light during daylight hours.

In another embodiment, as a vehicle 220 approaches the inner portion of a curve 230, the curve markers 200 and 210 clearly delineate for the driver the curve even though markers 200 and 210 may not be directly illuminated by the headlights of vehicle 220. In addition, as vehicle 220 rounds curve 230 and approaches a stalled vehicle 240, markers 210 alert the driver of vehicle 220 to the impending hazard posed by stalled vehicle 240 by emitting, for example, yellow light. Similarly, markers 200 and 210 can detect light from headlights of vehicle 220 and alert people around curve 230 of the approach of vehicle 220. In addition to changing colors in response to ambient light or highway conditions, marker 200 or 210 may be directed to change the color of emitted light upon receipt of an RF, IR, or other signal, where the signal originates from a central station or from another marker. While performing the above described functions, markers 200 or 210 may simultaneously emit signals to a computer on board vehicle 220 to indicate the relative speed and position of vehicle 220. These signals can typically be IR or RF.

In one embodiment, the shell would be fabricated from metal. The metal would provide flexibility and impact strength. In another embodiment, the housing would be injection molded from a glass or carbon reinforced plastic such as polycarbonate. This plastic is sold under the trade names Lexan by the GE Plastics of Pittsfield, Mass. Lexan 141 or 503 as well as several other grades would be suitable for this application. Other plastics that would be appropriate include Acrylonitrile Butadiene Styrene (ABS) and Acrylic Styrene Acrylonitrile (ASA).

Other embodiments of the invention will be apparent to those skilled in the art from consideration of the specification and practice of the invention disclosed herein. It is intended that the specification and examples be considered as exemplary only, with a true scope and spirit of the invention being indicated by the following claims.

What is claimed is:

1. A highway marker comprising:

a housing;

a plurality of LED's mounted in the housing, at least two of the LEDs being operational to emit electromagnetic radiation at different frequencies to each other to produce different colors;

a photodetector generating a signal responsive to an ambient light condition surrounding the housing; and a control circuit responsive to the photodetector signal to control the electromagnetic radiation from the LEDs so as to control the overall color of the highway marker as perceived by the human eye according to the spectral sensitivity of the human eye for the ambient light condition.

2. A highway marker according to claim 1, further comprising a power source integral with the housing for powering the plurality of LED's.

3. A highway marker according to claim 1, further comprising a cooling fin in thermal communication with at least one LED, wherein the cooling fin dissipates LED generated heat.

4. A highway marker according to claim 1, further comprising a thermally conductive member extending through the surface on which the marker is mounted and into a cooler region beyond the surface to provide thermal communication between the LEDs and the cooler region.

5. A highway marker according to claim 1, wherein at least one LED emits electromagnetic radiation in the range of $10^{-2}$ m to $10^{-8}$ m.

6. A highway marker according to claim 1, wherein at least one LED emits electromagnetic radiation that is filtered with tinted material.

7. A highway marker according to claim 1, wherein at least one LED has a substrate selected from silicon, gallium nitride, aluminum nitride, aluminum oxide, silicon carbide, diamond, silicon germanium, and germanium.

8. A highway marker according to claim 1, further comprising a photovoltaic cell for generating power.

9. A highway marker according to claim 2, wherein the power source is a battery.

10. A highway marker according to claim 2, wherein the power source is a line power source.

11. A highway marker according to claim 1 further comprising a power source and wherein the plurality of LED's and the power source has a plurality of redundancies.

12. A highway marker according to claim 1 further comprising a battery to heat the housing.

13. A highway marker according to claim 1, wherein the photodetector is responsive to electromagnetic radiation in the range of $10^{-2}$ m to $10^{-8}$ m.

14. A highway marker according to claim 1, wherein the LEDs include LEDs operating in at least one of the ultraviolet (UV) and infra red (IR) range.

15. A highway marker according to claim 1, including an internal feedback providing a constant brightness of the LED's.

* * * * *

UNITED STATES PATENT AND TRADEMARK OFFICE

CERTIFICATE OF CORRECTION

PATENT NO. : 7,273,328 B2
APPLICATION NO. : 10/947053
DATED : September 25, 2007
INVENTOR(S) : Hunter et al.

It is certified that error appears in the above-identified patent and that said Letters Patent is hereby corrected as shown below:

On the title page, item [60] should read:

--Provisional application No. 60/362,551, filed on March 8, 2002.--.

Signed and Sealed this

Fourteenth Day of October, 2008

JON W. DUDAS
*Director of the United States Patent and Trademark Office*